US006742629B2

(12) United States Patent
Veletovac et al.

(10) Patent No.: US 6,742,629 B2
(45) Date of Patent: Jun. 1, 2004

(54) VALVE CONTROL UNIT FOR A HYDRAULIC ELEVATOR

(75) Inventors: Sead Veletovac, Dübendorf (CH); Luigi Del Re, Zürich (CH); Andreas Schrempf, Waidhofen/Ybbs (AT)

(73) Assignee: Wittur AG, Wiedenzhausen (DE)

( * ) Notice: Subject to any disclaimer, the term of this patent is extended or adjusted under 35 U.S.C. 154(b) by 0 days.

(21) Appl. No.: 10/018,354

(22) PCT Filed: Jun. 1, 2001

(86) PCT No.: PCT/EP01/06273

§ 371 (c)(1),
(2), (4) Date: Dec. 19, 2001

(87) PCT Pub. No.: WO02/02974

PCT Pub. Date: Jan. 10, 2002

(65) Prior Publication Data

US 2002/0153204 A1 Oct. 24, 2002

(30) Foreign Application Priority Data

Jul. 3, 2000 (CH) ..... 1312/00

(51) Int. Cl.[7] ..... B66B 9/04

(52) U.S. Cl. ..... 187/275; 187/272; 187/285; 91/418

(58) Field of Search ..... 187/272, 275, 187/276, 285, 286, 287, 288; 91/418, 461

(56) References Cited

U.S. PATENT DOCUMENTS

| | | | | | |
|---|---|---|---|---|---|
| 3,892,292 | A | * | 7/1975 | Takenoshita et al. | 187/275 |
| 4,153,074 | A | | 5/1979 | Risk | 137/596.12 |
| 4,368,805 | A | * | 1/1983 | Rued | 187/275 |
| 4,438,831 | A | * | 3/1984 | Rohanna | 187/276 |
| 4,637,495 | A | | 1/1987 | Blain | 187/286 |
| 4,909,279 | A | * | 3/1990 | Nakamura et al. | 91/446 |
| 5,040,639 | A | | 8/1991 | Watanabe et al. | 187/275 |
| 5,232,070 | A | * | 8/1993 | Blain | 187/275 |
| 5,285,027 | A | * | 2/1994 | Nakamura et al. | 187/275 |
| 5,289,901 | A | * | 3/1994 | Fargo | 187/275 |
| 5,522,479 | A | * | 6/1996 | Jo | 187/275 |
| 5,593,004 | A | * | 1/1997 | Blain | 187/275 |
| 5,636,652 | A | * | 6/1997 | Toschi et al. | 187/275 |
| 6,142,259 | A | * | 11/2000 | Veletovac et al. | 187/287 |

FOREIGN PATENT DOCUMENTS

| | | | | |
|---|---|---|---|---|
| EP | 528099 | * | 2/1993 | 187/275 |
| EP | 0 964 163 A2 | | 12/1999 | |
| EP | 0 964 163 A3 | | 12/1999 | |
| EP | 0 964 163 | | 12/1999 | |
| JP | 09124256 | * | 5/1997 | |
| JP | 09208160 | * | 8/1997 | |
| JP | 410182038 | * | 7/1998 | |
| WO | WO 98/34868 | | 8/1998 | |
| WO | 02/02974 | | 1/2002 | |

* cited by examiner

*Primary Examiner*—Eileen D. Lillis
*Assistant Examiner*—Paul T. Chin
(74) *Attorney, Agent, or Firm*—Birch, Stewart, Kolasch & Birch, LLP

(57) ABSTRACT

A control valve unit for a hydraulic elevator includes two control valves wherein the flow of hydraulic oil from a tank to a lifting cylinder driving an elevator cabin and/or from the lifting cylinder to the tank can be controlled. In case of an upward movement of the elevator cabin, hydraulic oil is conveyed by a pump driven by an electromotor from the tank through the control valve unit to the lifting cylinder. In the case of a downward movement of the elevator cabin, the hydraulic oil flows through the control valve unit to the tank without the pump working. The control of the upward movement and the downward movement of the elevator cabin is achieved by one single pilotable control valve, respectively, that are provided to act as a check valve as well as a proportional valve.

20 Claims, 5 Drawing Sheets

VALVE CONTROL UNIT FOR A HYDRAULIC ELEVATOR

This application is the national phase under 35 U.S.C. § 371 of PCT International Application No. PCT/EP01/06273 which has an International filing date of Jun. 1, 2001, which designated the United States of America and was published in English.

BACKGROUND OF THE INVENTION

1. Field of the Invention

The invention pertains to a control valve unit for an hydraulic elevator that does not require adjustment elements.

2. Description of Background Art

Such control valve units are used for influencing the flow of hydraulic oil between a pump or a tank, respectively, and a drive cylinder for the direct or indirect drive of an elevator cabin.

A control valve unit is known from U.S. Pat. No. 5,040,639. This control valve unit includes three pilot control valves as well as a return valve in which the opening status is monitored using a position indicator. In addition also still some adjustment elements exist beside fixed chokes.

From EP-A2-0 964 163 a similar control valve unit is known which is of a substantially more complex construction and which beside four main control valves and three pilot valves includes a series of mechanical adjustment elements.

SUMMARY AND OBJECTS OF THE INVENTION

The invention is based on the object of creating a control valve unit which is of simple construction and can do without adjustment elements. This results in low manufacturing costs and during installation time-consuming adjustments are not required.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
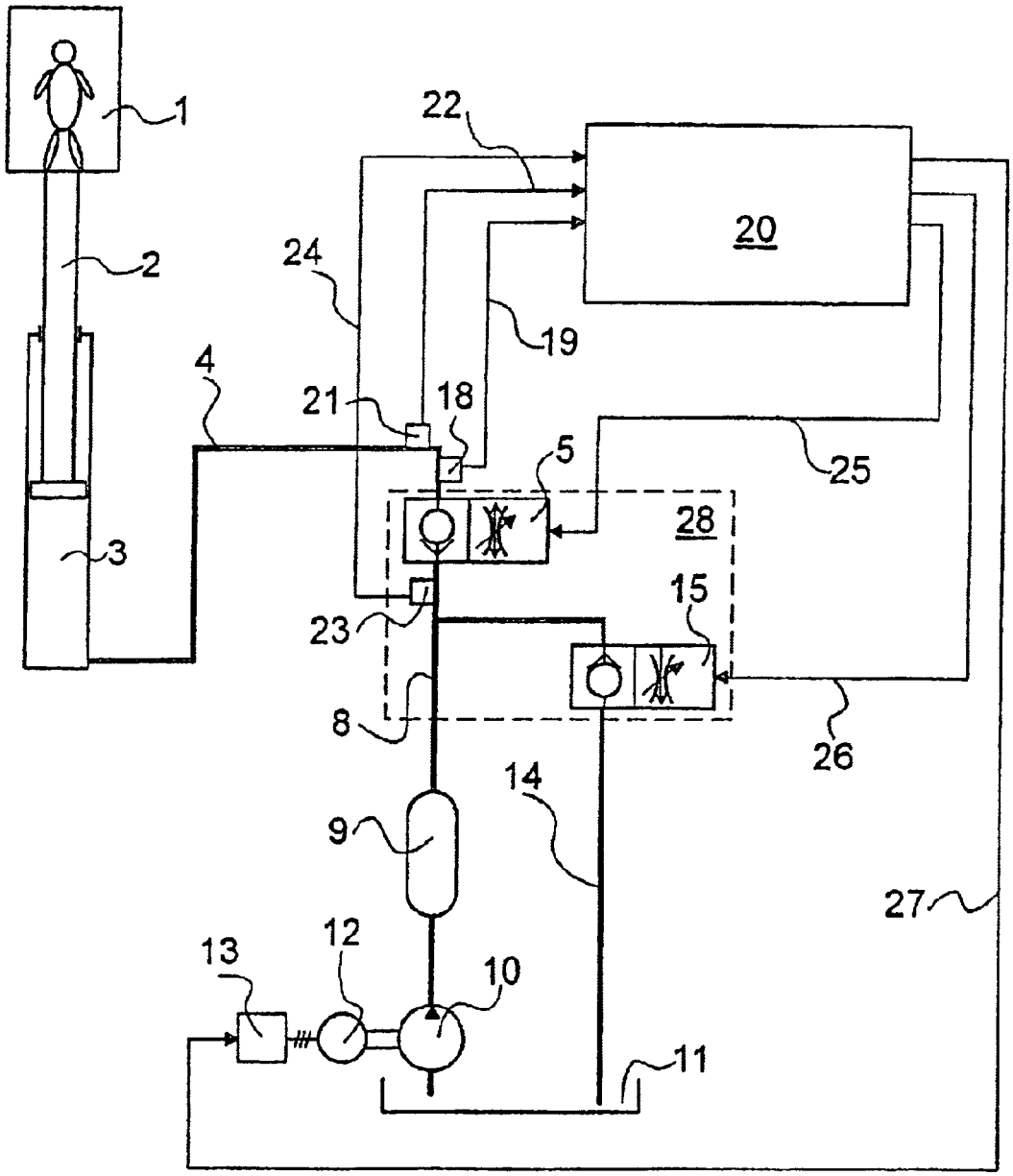
FIG. 1 shows a scheme of the hydraulic elevator with the apparatus for control thereof.

In FIG. 1, 1 denominates an elevator cabin of an hydraulic elevator movable by a lifting piston 2. Said lifting piston 2 together with a lifting cylinder 3 forms a known hydraulic drive. To said hydraulic drive a cylinder line 4 is connected through which hydraulic oil can be conveyed. Said cylinder line 4 on the other hand is connected to a first control valve 5 which combines at least the function of a proportional valve and a check valve, so that it acts either like a proportional valve or like a check valve, this depending on the fact how said control valve 5 is selected which will be discussed later. The proportional valve function therein can be achieved in known manner using a main valve and a pilot valve, wherein said pilot valve is actuated by an electric drive, e.g. a proportional magnet. The closed check valve holds the elevator cabin 1 in the respective position.

Via a pump line 8 in which a pressure pulsation absorber 9 can be arranged, said control valve 5 is connected to a pump 10 by means of which hydraulic oil is conveyable from a tank 11 to said hydraulic drive. Said pump 10 is driven by an electromotor 12 to which a current supply member 13 is correlated. In said pump line 8 a pressure Pp is prevailing.

Between said control valve 5 and said tank 11 a further line exists containing hydraulic oil, namely return line 14 in which a second control valve 15 is arranged. Said control valve 15 permits the almost resistance-free return of the hydraulic oil from said pump 10 to said tank 11 when the pressure Pp exceeded a given threshold value. Due thereto, said pressure Pp cannot exceed said threshold value substantially. Now, said threshold value can be changed by an electrical signal so that said control valve 15 can take over a pressure regulating function in a manner similar to that of a known proportional valve. Also for achieving this function one can, like in a proportional valve, in known manner go back to a main valve and a pilot valve which is actuated by a proportional magnet which is electrically selectable.

In said cylinder line 4 a load pressure sensor 18 connected to a control device 20 via a first measuring line 19 is arranged at the control valve 5 itself or preferably directly at the corresponding terminal of said control valve 5. Said control device 20 serving for the operation of said hydraulic elevator thus is in a position to recognize which pressure $P_z$ is prevailing in said cylinder line 4. Said pressure $P_z$ in case of said elevator cabin at rest represents the load of said elevator cabin 1. With the aid of said pressure $P_z$ it is possible to influence control and regulating operations and to detect operating states. Said control device 20 can also be formed of several control and regulating units.

Advantageously a temperature sensor 21 connected to said control device 20 via a second measuring line 22 is arranged in said cylinder line 4 again preferably directly at the corresponding terminal of said control valve 5 or at said control valve 5 itself. Since hydraulic oil shows a viscosity clearly varying with temperature, the control and regulation of said hydraulic elevator can be clearly improved if the temperature of said hydraulic oil is included as parameter into control and regulation operations.

Preferably a further pressure sensor, namely a pump pressure sensor 23, is provided for which detects the pressure Pp in said pump line 8 and which preferably is arranged directly at the corresponding terminal of said pump line 8 at said control valve 5. Said pump pressure sensor 23 transmits its measuring value via a further measuring line 24 also to said control device 20.

From said control device 20 a first control line 25 leads to said control valve 5. Thereby said control valve 5 is electrically controllable by said control device 20. Besides, a second control line 26 leads to said control valve 15 so that also this one is controllable by said control device 20. In addition a third control line 27 lead from said control device 20 to said current supply element 13, this permitting the motor 12 being switched on and off and, if required, also the speed of the motor 12 and thus the conveyed amount of said pump 10 being influenceable by said control device 20.

By addressing said control valves 5 and 15 by said control device 20 it is determined in which way said control valves 5 and 16 behave functionally. If said control valves 5 and 15 are not selected by said control device 20, both control valves 5 and 15 in principle act like a variably biasable check valve. If said control valves 5 and 15 are selected by a control signal, they act as proportional valves.

In accordance with the present invention both control valves 5 and 15 are combined in a control valve unit 28, this being indicated in the drawing by a dashed line enclosing both control valves 5 and 15. This provides the advantages that mounting expenses on the building site of said hydraulic elevator are reduced. In accordance with the general inventive thought both control valves 5 and 15 are similar and are constructed using identical parts which provides different advantages which will be discussed later.

Before the gist of the invention is discussed in detail, at first the principle way of function be explained: During standstill of said elevator cabin 1 it is essential that the control valve 5 is closed now which, as already mentioned, is achieved in that it does not receive a control signal via said signal line 25 from said control device 20, i.e. it acts as check valve. The control valve 15 can be closed as well, but this is not necessarily the case always. Thus it is possible that also during standstill of said elevator cabin the pump 10 is working, i.e. conveying hydraulic oil, that, however, said conveyed hydraulic oil flows through said control valve 15 back into the tank 11. As a rule, however, during standstill both control valves 5 and 15 do not receive control signals from said control device 20 so that in both cases only the check valve function is possible.

Said control valve 5 not selected electrically automatically closes by the effect of the pressure $P_z$ generated by said elevator cabin 1 when said pressure $P_z$ is higher than the pressure Pp. It was already mentioned that in this condition the load pressure sensor 18 indicates the load caused by said elevator cabin 1. Thereby, the effective load of said elevator cabin 1 is found and transmitted to said control device 20. Said control device 20 thus can recognize whether said elevator cabin 1 is empty or loaded and thus also the magnitude of load is known.

When said elevator cabin 1 is to move in upward direction, at first said current supply element 13 is activated by said control device 20 via said control line 27 and thus the electric motor 12 is made rotate, this causing the pump 10 to work and to convey hydraulic oil. Thereby, the pressure Pp in said pump line 8 is increasing. As soon as said pressure Pp exceeds a value correlated to the biasing of said check valve of said control valve 15, said check valve of said control valve 15 opens so that said pressure Pp at first cannot exceed said value. If said pressure value—and this will be the case usually—is lower than the pressure $P_z$ in said cylinder line 4, said control valve 5 remains closed and no hydraulic oil flows into said cylinder line 4. Thus, switching on of said pump 10 does not yet cause movement of the elevator cabin 1, since the entire amount of hydraulic oil conveyed by said pump 10 in this case is returned to said tank 11 through said control valve 15. In order to achieve a movement of said elevator cabin 1, now said control device 20 can control the proportional valve function of said control valve 15 via said signal line 26 so that an increased hydraulic resistance is adjusted on said control valve 15. This now permits to increase said pressure Pp so much until the required amount of hydraulic oil can flow into said cylinder line 4 through said control valve 5. Therein part of the flow of hydraulic oil conveyed by said pump 10 flows back into said tank 11 through said control valve 15. The portion of the flow of hydraulic oil conveyed by said pump 10, that is not guided back into said tank 11 via said control valve 15 flows through said control valve 5 acting as check valve due to the prevailing pressure difference into said cylinder line 4 via said control valve 5 and thus lifts said elevator cabin 1. In this way a continuous control of said hydraulic oil flowing to said lifting cylinder 3 is possible without the speed of said pump 10 having to be regulated. It only is required that said pump 10 is constructed such that is can deliver a conveyed amount of hydraulic oil sufficient for the maximum speed of said elevator cabin in case of maximum counterpressure to be expected in case of nominal speed, wherein the common reserve factors and other marges have to be accounted for.

Figure 2:
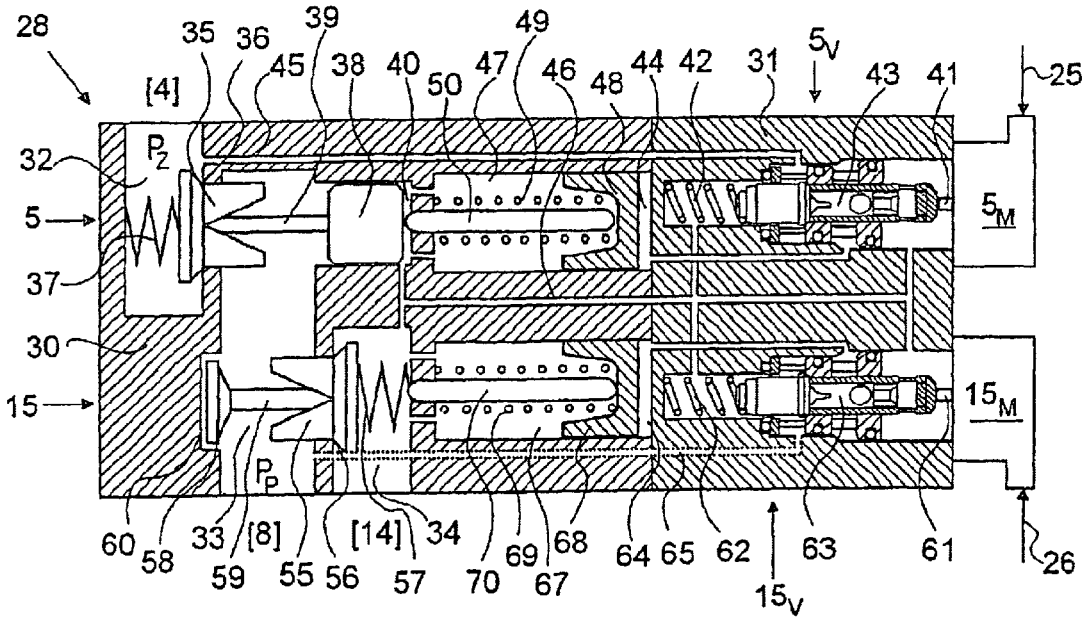
FIG. 2 shows a control valve unit in a schematic top view.
Figure 3:
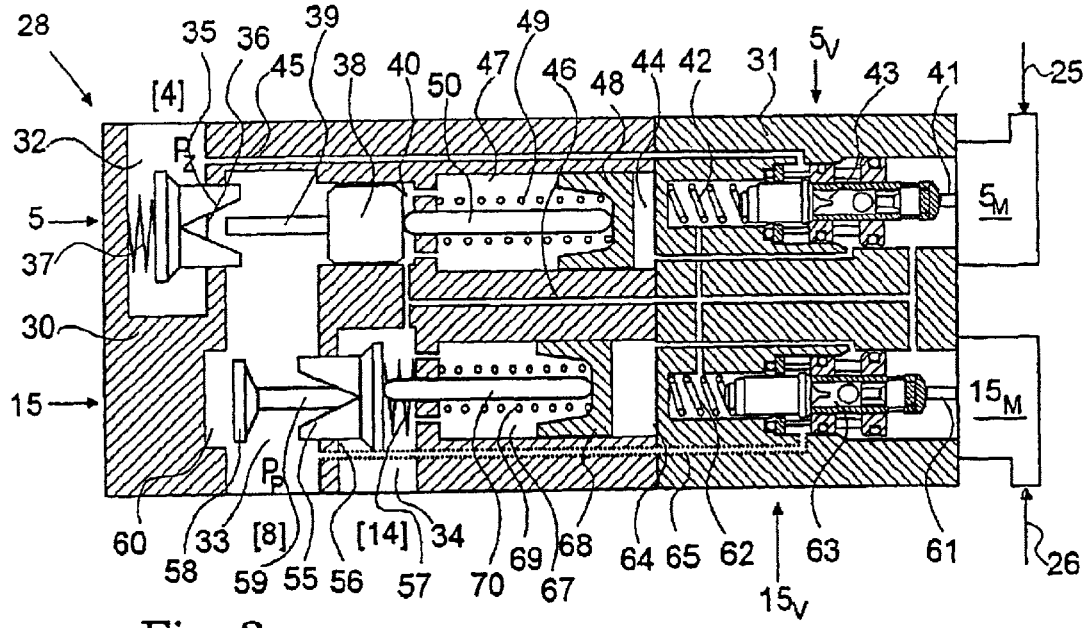
FIG. 3 shows the same control valve unit in case of selection for upward movement of the hydraulic elevator.
Figure 4:
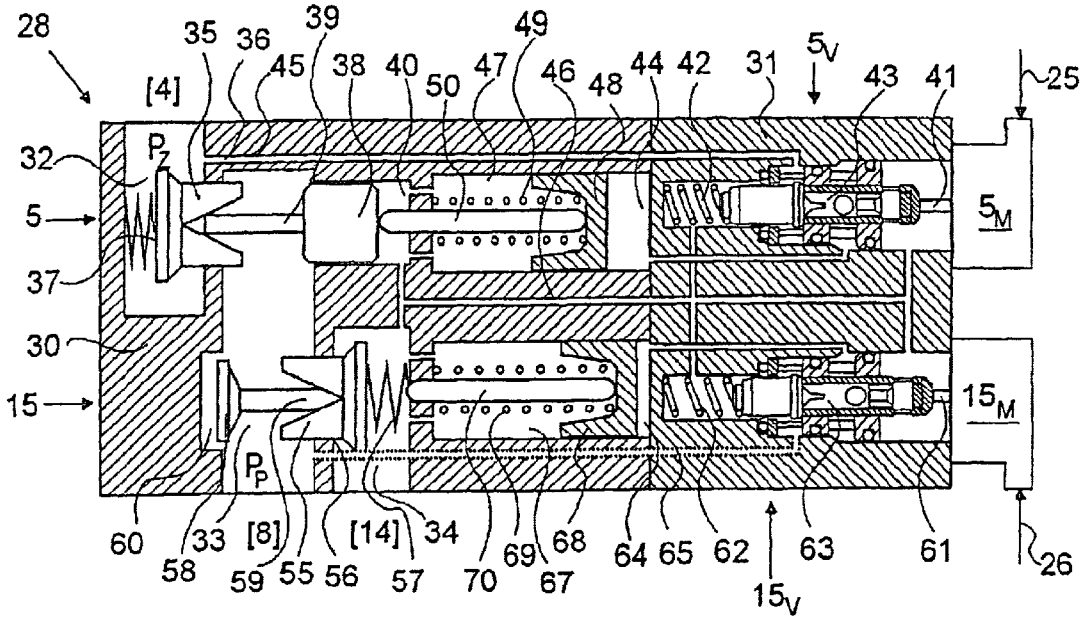
FIG. 4 is like FIG. 3, but in case of selection of downward movement.

A first embodiment of the control valve 28 in accordance with the present invention is shown in FIGS. 2 to 4. Therein, FIG. 2 shows a basic state without any selection of control valves 5 and 15 contained in the control valve unit 28. FIG. 3 shows a state during upward movement of the elevator cabin 1 (FIG. 1), whereas FIG. 4 shows the state during downward movement.

In FIGS. 2 to 4 said control valve unit 28 is shown which represents a unification of said control valves 5 and 15. In the figures the upper part shows said control valve 5, the lower part—control valve 15. [4] shows the connection of said control valve unit 28 to said cylinder line 4 (FIG. 1), [8] shows the connection to said pump line 8 and [14] shows the connection to said return line 14. In the connection areas the pressures $P_z$ and Pp prevailing there are indicated, which have been mentioned earlier in the description and which can be detected by the pressure sensors not shown here. Each of said control valves 5 and 15 consists of a main valve and a pilot valve which again is actuated by a proportional magnet respectively.

Said control valve unit 28 consists of two housing parts, namely a first housing part 30 containing the main valves of said control valves 5 and 15, and a second housing part 31 accommodating the relating pilot valves denominated with $5_v$ and $15_v$. Therein said housing part 31 itself can be a two-part member in that each of said pilot valves $5_v$ and $15_v$ has an own housing part. To each of said pilot valves $5_v$ and $15_v$ a proportional magnet is correlated, namely proportional magnet $5_M$ to pilot valve $5_v$ and proportional magnet $15_M$ to pilot valve $15_v$. Said proportional magnets $5_M$ and $15_M$ can be selected by the control device 20 (FIG. 1) via control lines 25 and/or 26, respectively.

Said first housing part 30 contains several chambers. A first chamber is referred to as cylinder chamber 32. This one is followed by the cylinder line 4 (FIG. 1), this being the reason why the corresponding connection is referred to by [4]. A second chamber is referred to as pump chamber 33 which is followed by said pump line 8, this being shown with reference [8]. A further chamber is referred to as return chamber 34 followed by said return line 14, this correspondingly being referred to with reference [14].

In an opening between said cylinder chamber 32 and said pump chamber 33 a first choke body 35 is arranged which together with a first valve seat 36 formed in said housing part 30, forms the main valve of said control valve 5. In accordance with the present invention said main valve of said control valve 5 is the essential element directly influencing the flow of hydraulic oil from and to said lifting cylinder 3 (FIG. 1). For sake of completeness it should be mentioned that depending on the selection of said pilot valve $\mathbf{5}_v$ a low partial flow can also flow through said pilot valve $\mathbf{5}_v$. Said main valve of said control valve 5 includes the function of a check valve and simultaneously the function of a proportional valve, this being explained in the following. The check valve therein meets the safety demands listed in EN security standards so that an additional safety valve is not required.

The flow restrictor 35 on one hand is actuated by a return spring 37. By said return spring 37 the main valve is kept closed as long as the pressure Pp in said pump chamber 33 does not exceed the pressure $P_z$ in said cylinder chamber. This is the case e.g. when said pump 10 (FIG. 1) is not working and the elevator cabin 1 (FIG. 1) is at rest.

On the other hand setting elements which are moved by the selection of said pilot valve $\mathbf{5}_v$ act on said flow restrictor 35. Said setting elements include an opposed piston 38 with check rod 39 fixed thereto. Said opposed piston 38 is shiftable in a guide area 40 arranged in said housing part 30. Said opposed piston 38 on one hand is actuable from said pilot valve $\mathbf{5}_v$, and namely as follows. From said proportional magnet $\mathbf{5}_M$ in known manner action is effected on a pilot piston 43 through a solenoid plunger 41 against a pilot regulation spring 42. The movement of said pilot piston 43 results in the creation of a control pressure $P_x$ in a control pressure chamber 44. Said control pressure $P_x$ depends on the movement of said pilot piston 43 and thus also is determined by said pilot regulation spring 42. In that said pilot valve $\mathbf{5}_v$ via a first connecting channel 45 detects the pressure $P_z$ in said cylinder chamber 32 and via a second connecting channel 46 also detects the pressure prevailing in said return chamber 34, no setting elements are required for achieving the correct control pressure $P_x$.

Said pilot valve 5V regulates said control pressure $P_x$, said control pressure $P_x$ being a function of the pressures in cylinder chamber 32 and return chamber 34 and of the lift of pilot piston 43 which again is determined by the selection of said pilot valve $\mathbf{5}_v$.

By said control pressure PX action is effected on a piston 48 shiftable in a control chamber 47. Said piston 48 is supported against said housing part 30 through a main valve regulation spring 49. The movement of said piston 48 is transmitted to said opposed piston 38 by means of a check rod 50. Said main valve regulation spring 49 thus on one hand acts as return spring for said piston 48 and on the other hand however also as regulating spring for said main valve of said control valve 5. Here, too, in accordance with the present invention no setting elements are required.

In accordance with the invention thus only one single flow restrictor 35 is required which together with said valve seat 36 influences and/or determines, respectively, the flow of the hydraulic oil from and to said lifting cylinder 3 (FIG. 1) in order to achieve the functions as check valve and as proportional valve as well.

The second control valve 15 also is constructed in accordance with the same basic principle. In an opening between said pump chamber 33 and said return chamber 34 a second flow restrictor 55 is arranged which together with a second valve seat 56 built in said housing part 30 forms the main valve of said control valve 15. Said main valve of said control valve 16 also includes the function of a check valve and simultaneously the function of a proportional valve, which is explained in the following.

Said flow restrictor 55 on one hand is actuated by a return spring 57. By said return spring 57 said main valve is kept closed as long as the pressure Pp in said pump chamber 33 does not exceed the pressure in said return chamber 34. This e.g. is the case when said pump 10 (FIG. 1) is not working.

On the other hand setting members moved by the selection of said pilot valve $\mathbf{15}_v$ act on said flow restrictor 55. In contrast to the above-described control valve 5, in said control valve 15 the action of said proportional magnet $\mathbf{15}_M$ on said flow restrictor 55 is effected without intermediation of an opposed piston. Also said flow restrictor 55 is actuable via said pilot valve $\mathbf{15}_v$, and namely as follows. Via said proportional magnet 15M in known manner action is effected on to a pilot piston 63 via a solenoid plunger 61 against a pilot regulation spring 62. The movement of said pilot piston 63 results in the creation of a control pressure $P_Y$ in a control pressure chamber 64. Said control pressure $P_Y$ depends on the movement of said pilot piston 63 and thus also is determined by said pilot regulation spring 62. In that said pilot valve $\mathbf{15}_v$ detects the pressure Pp in said pump chamber 33 via a further connecting channel 65 and via said above-mentioned connecting channel 46 also detects the pressure prevailing in said return chamber 34, no setting elements are required in order to achieve the correct control pressure $P_Y$. Said connecting channel 65 is shown in dotted line, because it is located in another plane to enable it to establish the connection between pilot valve $\mathbf{15}_v$ and pump chamber 33, therein by-passing said return chamber 34.

Said pilot valve $\mathbf{15}_v$ regulates said control pressure $P_Y$, said control pressure $P_Y$ being a function of the pressures in pump chamber 33 and return chamber 34 and of the lift of said pilot piston 63 which again is determined by the selection of said pilot valve $\mathbf{15}_v$. By said control pressure $P_Y$ action is effected on a piston 68 shiftable in a control chamber 67. Said piston is supported against said housing part 30 via a main valve regulation spring 69. The movement of said piston 68 is transmitted to said flow restrictor 55 by means of a check rod 70. Said main valve regulation spring 69 thus on one hand acts as return spring for the piston 68 and on the other hand however also as regulating spring for said main valve of said control valve 15. Here, too, in accordance with the present invention no setting elements are required.

Easier comprehension is rendered possible with reference to FIG. 3. Here, namely, a state is shown in which said pump 10 is working, due to the increased pressure Pp has pressed said flow restrictor 55 against said return spring 57 and thus lifted it from said valve seat 56. The proportional magnet $\mathbf{15}_M$ is selected, whereby said piston 68 due to the increased control pressure $P_Y$ is shifted to the left side, i.e. in direction to said flow restrictor 55. The movement of said piston 68 is directly transmitted to said flow restrictor 55 by said check rod 70.

As soon as said pump 10 starts working, the pressure Pp increases. Thus, however, immediately said main valve of said control valve 15 is opened in that said flow restrictor 55 moves against said return spring 57. The hydraulic oil conveyed by said pump 10 flows from said pump chamber 33 into said return chamber 34 and from there through said return line 14 (FIG. 1) to said tank 11. It should be mentioned in supplementation that said flow restrictor 35 of said control valve 5 cannot be moved against said return spring 37 since due to the comparatively high pressure $P_z$ produced by the load of said elevator cabin 1, said main valve of said first control valve 5 in any case remains closed because of the positive pressure difference $P_z$–Pp.

For now initiating the upward movement for said elevator cabin 1, the proportional valve function of said control valve 15 is activated, as already mentioned in the beginning. This is done by selecting said proportional magnet $\mathbf{15}_M$ via said control line 26.

It is further shown in FIG. 3 that due to the increased pressure Pp also said flow restrictor 35 of said man valve of said first control valve 5 was moved against said return spring 37. This movement can occur as soon as said pressure Pp is so much higher than said pressure $P_z$ that also the force of said return spring 37 is overcome. In the state shown in FIG. 3 thus hydraulic oil is conveyed through said cylinder line 4 into said lifting cylinder 3, this effecting the upward movement of said elevator cabin 1. It has to be noted that opening of said man valve of said control valve 5 is effected without selection of said proportional magnet $\mathbf{5}_M$, i.e. without cooperation of said pilot valve 5V alone because of the positive pressure difference Pp–$P_z$. The upward movement of said elevator cabin 1 thus is achieved by selection of said proportional magnet $\mathbf{15}_M$ alone and said main valve of said control valve 5 only has check valve function.

In analogy to said control valve 5 also said control valve 15 comprises an opposed body 58 and a check rod 59. In difference to said control valve 5 in which said check rod 39 is fixed to said opposed piston 38, while said flow restrictor 35 is a separate component, in said control valve 15 said opposed body 58, check rod 59 and flow restrictor 55 from one single component. These differences can be clearly seen in FIGS. 2 and 3. Said opposed body 58 is located in a recess 60 in said first housing part 30 when said control valve 15 is closed. The diameter of said recess 60 can be clearly larger than the diameter of said opposed body 58. If this is the case, said opposed body 58 in terms of action of force has no influence on said main valve, formed out of flow restrictor 55 and valve seat 56, of said control valve 15. Preferably, in said recess 60 guide ribs may be arranged by which said opposed body 58 is guided.

With respect to function, said opposed bodies 38 and 58 have different meanings. On said opposed bodies 38 and 58 the pressure in said pump chamber 33 acts in the same manner like on said flow restrictors 35 and 55. If now in advantageous manner the diameters of opposed bodies 38 and 58 are identical with the diameters of flow restrictors 35 and 55, this causes force balancing. In said first control valve 5 in which flow restrictor 35 on one hand and opposed body 38 with check rod 39 on the other side are separate components, the same force caused by pressure Pp acts on said opposed body 38 and on said flow restrictor 35. Said force which has to be produced by said pilot valve $\mathbf{5}_M$ for moving said piston 48 and said check rod 60 against the opposed body 38 and said flow restrictor 35, thus is not changed by difference forces. In said control valve 15 the rigid connection of said opposed piston 58 with said flow restrictor 55 is required because here said opposed piston 58 is located on the side of said main valve, not facing said pilot valve $\mathbf{15}_M$ so that force transmission is not effected through said opposed piston 58. As the diameter of said recess 60 is clearly larger than the diameter of said opposed piston 58, in said opposed piston 58 the pressure Pp has all-side action, i.e. does not create counterforce onto said flow restrictor 55.

In FIG. 4 a position of said control valve unit 28 during downward movement of said elevator cabin 1 (FIG. 1) is shown. The pump 10 (FIG. 1) does not work at that time. Correspondingly, the pressure Pp is low. Prior to the begin of the downward movement of said elevator cabin 1, due to the fact that the pressure PZ in said cylinder chamber 32 is clearly higher than the pressure Pp in said pump chamber 33, said main valve of said control valve 5, formed of flow restrictor 35 and seat 36 is closed. For initiating the downward movement of said elevator cabin 1, said proportional magnet $\mathbf{5}_M$ is selected. This one via said solenoid plunger 41 acts onto said pilot valve $\mathbf{5}_v$ which creates the control pressure $P_x$ in said control chamber 47. The magnitude of said control pressure $P_x$ is determined by the selection of said proportional magnet $\mathbf{5}_M$ and said pilot regulating spring 42 and, of course, also is influenced by pressure $P_z$ in said cylinder chamber 32 and by the pressure in said return chamber 34. With increasing selection of said proportional magnet $\mathbf{5}_M$ said control pressure $P_x$ in said control pressure chamber 44 is increasing, whereby said piston 48 is moved against the force of said main valve regulating spring 49 in direction to said opposed piston 38. Therein, this movement is transmitted by said check rod 50 to said opposed piston 38. The movement thereof is transmitted via said check rod 39 to said flow restrictor 35. Thus, said main valve of said control valve 5 opens.

Due to said opening, now the pressure Pp in said pump chamber 33 increases. Thereby said flow restrictor 55 is pressed against said return spring 57 so that said flow restrictor 55 raises from said valve seat 56. The hydraulic oil now can flow through the main valve formed out of said flow restrictor 55 and said valve seat 56, of said control valve 15 through said return chamber 34 into said return line 14 (FIG. 1) and thus into said tank 11. For sake of completeness it should be mentioned that a portion of said hydraulic oil also can flow back from said pump chamber 33 through said pump line 8 (FIG. 1) and said pump 10 into said tank 11, since said pumps usually have a leakage loss. It depends on the kind of construction of said pump 10 and the spring ratio of said return spring 57, which partial flow will flow through said pump 10. Therein, depending on the kind of construction of said pump 10 it is very well possible that said pump 10 in spite of not being driven by the motor 12 is made rotate by the flow of hydraulic oil. For sake of completeness it should be mentioned as well that a further partial flow also flows through said pilot valve $\mathbf{5}_v$.

Said main valve formed out of flow restrictor 55 and valve seat 56, of said control valve 15 thus during downward movement acts as check valve which is opened by said pump pressure Pp alone. A selection of said proportional magnet $\mathbf{15}_M$ thus does not take place and thus also said pilot valve $\mathbf{15}_v$ is without function.

For controlling the upward and downward movements of said elevator cabin 1 (FIG. 1) thus in accordance with the present invention only said two control valves 5 and 15 are required which, respectively, combine in themselves the functions of check valve and proportional valve. Said check valve functions of said control valves 5 and 15 at the same time meet the demands of EN security standards. Therein, said control valve 1 carries out the function of the safety valve, whereas said control valve 15 renders an additional pump pressure control valve superfluous. Said control valve unit 28 in accordance with the present invention thus has a particularly simple construction and can be manufactured saving costs. When said flow restrictors 35 and 55 in accordance with a preferred embodiment of the present invention are identical, this also means an advantage with respect to manufacturing costs since it is not required to manufacture different flow restrictors.

Figure 5:
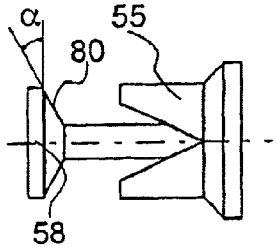
FIG. 5 shows a flow restrictor with opposed piston and check rod.

It is advantageous if said opposed bodies 38 and 58 on their side facing said flow restrictors 35 or 55, respectively, do not have a plane surface but the side facing said flow restrictor 35 or 55, respectively, has the shape of a truncated cone. In FIG. 5 the closure body 55 with opposed body 58 and said check rod 59 connecting these two components is shown. The surface facing said closure body 55 has the shape of a truncated cone 80. Preferably, the surface of said truncated cone 80 forms an angle $\alpha$ of about 15 to 25 degrees with respect to a surface standing in perpendicular to the longitudinal axis. Thereby it is achieved that dynamic forces created in case of high flow ratio through said main valve of said control valve 15 do not have disadvantageous effects on said pilot valve $\mathbf{15}_v$.

Figure 6:
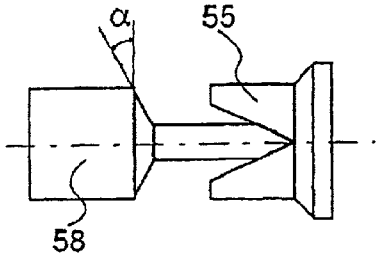
FIG. 6 shows a embodiment modification for the opposed piston.

It also is preferable if said opposed body 58 of said control valve 15 has the same shape and size like said opposed body 38 of said control valve 5. When said opposed bodies 38 and 58 are identical this provides the advantage that not so many different components have to be manufactured and kept on store and the production lot size is twice as high, this having favorable effect in terms of manufacturing costs. This is also is of importance with respect to service work in situ. In FIG. 6 an opposed body 58 is shown whose shape and size corresponds to said opposed body 38 (FIG. 4). Said angle $\alpha$ exists here, too.

Figure 7:
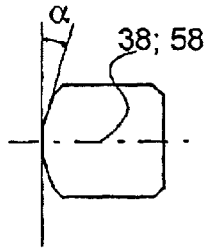
FIG. 7 shows a detail of the opposed piston

In FIG. 7 again said opposed body is shown which can be used as opposed body 38 for said control valve 5 and as opposed body 58 for said control valve 15, angle $\alpha$ again appearing here.

The size of said recess 60 is respectively adapted to the size of said opposed body 58. I.e. if said opposed body 68 is embodied in accordance with FIG. 5, the depth of said recess 60 is small. If, however, the size of said opposed body 58 is embodied in accordance with FIG. 6, the depth of said recess 60 is correspondingly larger so that said opposed body 68 finds room in said recess 60 in case of closed main valve of said second control valve 15.

In FIGS. 8*a* to 8*d* details of said flow restrictors 35, 55 are shown, namely different embodiment modifications. A base 90 is respectively followed by a cylinder 91 whose shell surface is denominated with reference numeral 92. In said cylinder 91 openings 93 are milled through which said hydraulic oil can pass. Preferably e.g. six uniformly distributed openings 93 are milled into the circumference of said cylinder 91. Said openings 93 can be of different shape. In the embodiment under FIG. 8*a* said openings 93 are V-shaped in the area subsequent to said base 90 and in the area subsequent thereto they have constant width. This results in that the efficient passage cross-section for the hydraulic oil with increasing lift of said flow restrictor 35, 55 at first increases progressively and then with further increasing lift increases linearly. In the embodiment under FIG. 8*b* the openings 92 have a bell-shaped form instead of said V-shaped form in the area subsequent to said base. This results in that the efficient passage cross-section for the hydraulic oil is not linear. Starting with closed state of said control valves 5 or 15, respectively, in case of actuation in opening direction the efficient passage cross-section for the hydraulic oil at first increases only slightly, then becomes increasingly larger with increasing lift and then later with further increasing lift becomes decreasingly larger. Subsequently it again remains constant.

Figure 8A:
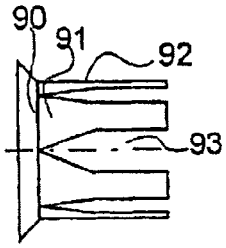
FIGS. 8*a* to 8*d* show modifications of the flow restrictor.
Figure 8B:
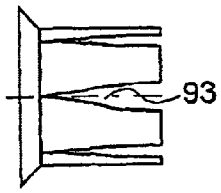
Figure 8C:
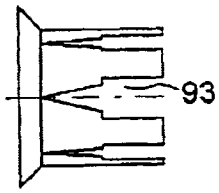

In FIG. 8*c* an example is shown in which said openings 93 are clearly stepped. In the first lifting area opening 93 is V-shaped and the abruptly merges into a rectangular form. This means that the efficient passage cross-section for the hydraulic oil in the beginning increases slightly and then jerkily changes to a maximum value, where then the efficient passage cross-section is independent of the further lift.

Figure 8D:
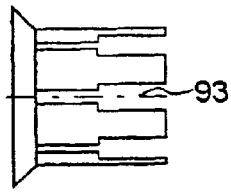

In FIG. 8*d* a further example is shown in which said openings 93 only are stepped. In the first lifting area said opening 93 has a small width and then abruptly changes into a rectangular form of larger width. This means that the efficient passage cross-section for the hydraulic oil in the beginning has a first value and then jerkily changes to a maximum value, where then the passage cross-section is independent of the further lift.

By the shape of said flow restrictors 35, 55 thus the passage characteristic of said control valves 5 and 15 can be adapted to the respective elevator system and to the manner of control in wide margins. The examples shown before let guess the possibilities offered. By different shapes of said flow restrictors 35 and 55 said control valves 5 and 15 thus can be adapted to different tasks and systems. In the known prior art for different uses respectively different kinds of construction and size are existing. By the invention it thus is achieved that by only one single control valve unit 28 by slight modifications smaller as well as larger elevator systems can be controlled.

Figure 9A:
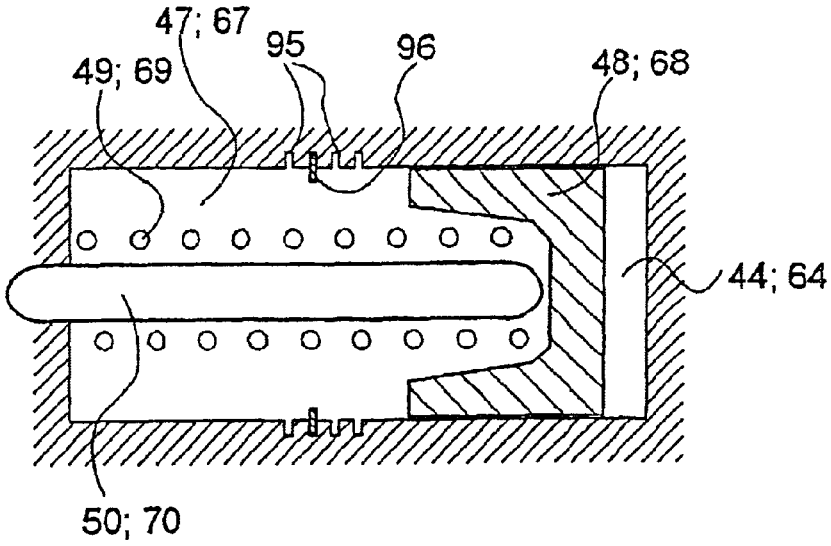
FIGS. 9*a* and 9*b* show modification of a lift limitation.
Figure 9B:
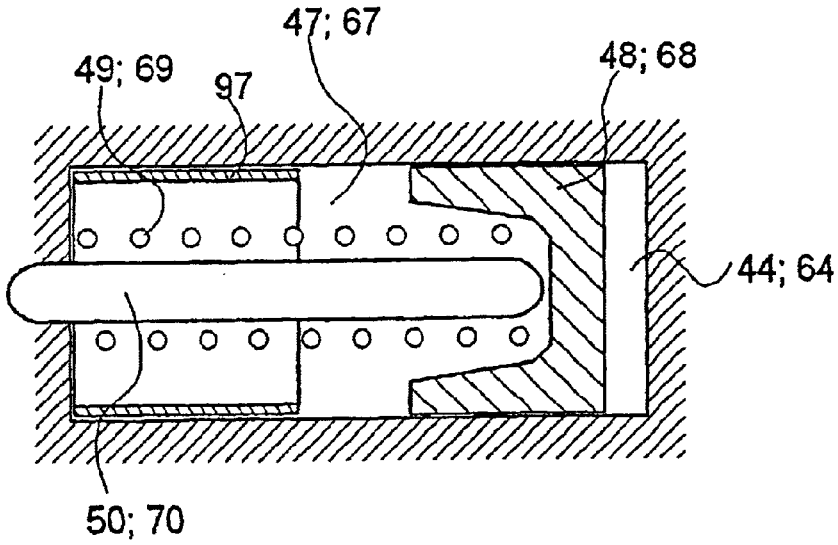

A further preferred embodiment consists in that a limitation of lift is provided for. Such limitation of lift can in advantageous manner be achieved in that the possible path of said piston 48 or 68, respectively, within said control chamber 47 or 67, respectively, is limited. In FIGS. 9*a* and 9*b* modification suitable therefor are shown.

In FIG. 9*a* a detail of FIGS. 2 to 4 is shown, namely said control chamber 47 or 67, respectively, with pistons 48 or 68, respectively, shiftable therein. Into the cylindrical inside wall of said control chamber 67 or 67, respectively, several annular grooves 95 are grooved. In said annular grooves 95 retainer rings 96 are insertable. Depending on the desired limitation of lift a retainer ring 96 is inserted in one of said annular grooves 95. Thereby the lift to be carried out by said piston 48 or 68, respectively, is limited. Exactly correspondingly thereto thus also the lift of said flow restrictor 35 or 55, respectively, of said control valves 5 or 15 (FIGS. 2 to 4) is restricted. In this way it is possible to determine during assembly of said control valve unit 28 for which maximum nominal flow said control valve unit 28 is to be dimensioned. Different structural sizes of control valve units 28 thus are not necessary.

A preferred modification of limitation of lift is shown in FIG. 9*b*. Here, the annular grooves 95 (FIG. 9*a*) which are problem in terms of manufacturing technology are not required. Instead a spacer ring 97 is inserted into said control chamber 47 or 67, respectively. The outer diameter thereof is slightly smaller than the diameter of said control chamber 47 or 67, respectively. Here, the length of said cylindrical spacer ring determines the limitation of lift. As compared to the modification under FIG. 9*a* in which possible limitations of lift, namely e.g. 5, 8, 11 and 14 mm, depend on the positions of said individual annular grooves 95, here it is possible to provide for arbitrary limitations of lift.

Figure 10:
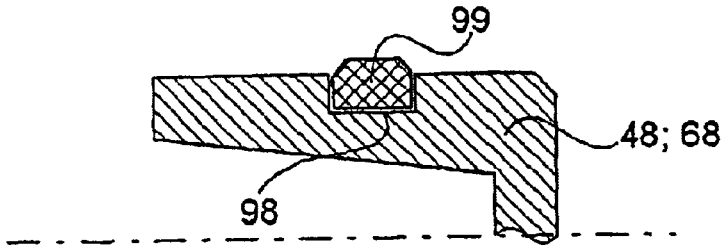
FIG. 10 shows a detail of a piston.

In FIG. 10 a detail of said pistons 48, 68 is shown. On their outer circumference they comprise a groove 98 into which an elastic annular sealing 99 is inserted. Due to said sealing 99 the gap between the cylindrical outer surface of said pistons 48, 68 and the inside wall of said control chamber 47, 67 (FIG. 2) is filled to large extent. Said sealing 99 in advantageous manner fulfils the object of reducing leakage, because due to it the leakage flow of hydraulic oil from said control chamber 47, 67 in direction to said main valve of said control valves 5, 15, is reduced decisively.

Figure 11:
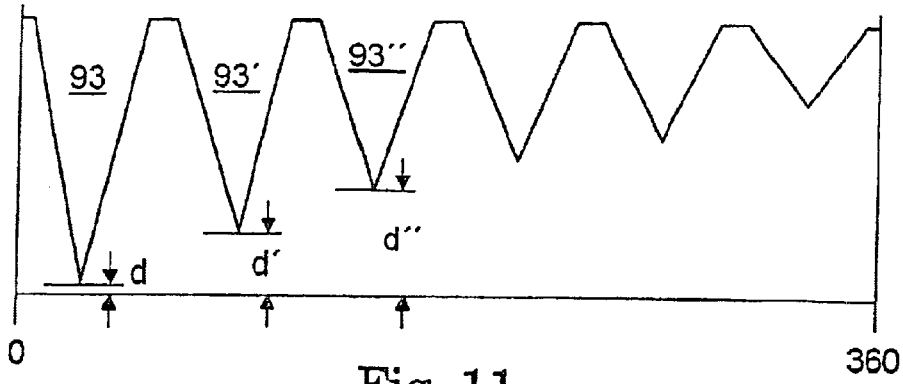
FIG. 11 shows a shell surface of the flow restrictor

In FIG. 11 the shell surface of a flow restrictor 35 (FIG. 2) is shown. Said openings 93 already mentioned in connection with FIGS. 8*a* to 83 and which there have different shape but respectively same size adapted to a flow restrictor 35, here now not all are of same size. Said opening 93 of FIG. 11 begins spaced with a distance d to said base 90 (FIGS. 8*a*–*d*), whereas a further opening 93' starts with a distance d' and a further opening 93"—with a distance d". The smallest distance d e.g. is 1 mm. Due to the different sizes of the individual openings 93 it is achieved in advantageous manner that by setting the individual distances d, d', d" etc., the flow characteristic depending on said valve lift can be arbitrarily set in order to make said flow characteristic adaptable to the respective needs.

Figure 12A:
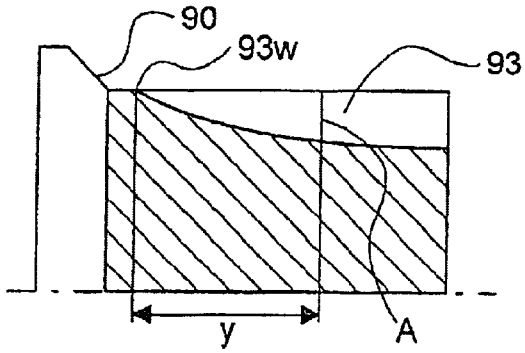
FIGS. 12*a* and 12*b* show sectional cuts through a flow restrictor and FIG. 13 shows a special design of an opening in the flow restrictor.
Figure 12B:
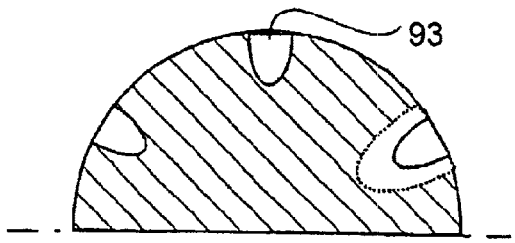

In FIGS. 12*a* and 12*b* further possible details of openings 93 are shown. In FIG. 12*a* an opening 93 is shown whose root 93*w* in analogy to FIG. 11 begins with a given distance to said base 90. The depth of such opening as well as also the width preferably are subject to a dimensioning rule characterized in that the efficient surface A of said opening 93 is a function of a distance y from said root 93*w*. A particularly preferred dimensioning rule therein is that the surface A is proportional to the $2.5^{th}$ power of the distance y, i.e. is subject to the following formula:

$$A=k\cdot y^{2,5}$$

In said formula k is a proportional factor.

FIG. 12*b* shows a section of FIG. 12*a* with a distance y of the root 93*w*. Therein, in contrast to the embodiment of FIG. 11, all openings 93 begin with their roots 93*w* (FIG. 12*a*) at the same distance to said base 90, but it also is conceivable that this solution is combined with that of FIG. 11, this being indicated in FIG. 12*b* in that with dotted line one of the openings is deeper because the root 93*w* thereof begins with less distance to said base 90.

Figure 13:
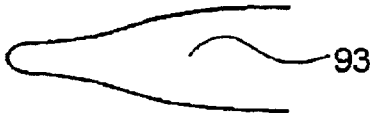

In FIG. 13 a border line of an opening 93 is shown in a particularly advantageous shape. In the region of the root of said opening 93 said opening 93 has a radius of e.g. 1 mm. A 180° arc is followed by curved border lines. By the design of said border lines particular flow characteristics can be achieved.

Basically the above-described particular measurements of design of said openings 93 serve for the purpose of achieving that in all flows a sufficiently great range for pressure regulation is available.

Said control valve unit 28 in accordance with the present invention was described in the beginning in connection with FIG. 1. Said pressure sensors 18 and 28 required in this kind of control were not shown in the further figures since the pre-known prior art already gives ideas therefor. The same also is true for the temperature sensor.

The control valve unit 28 in accordance with the present invention, however, is not only intended for being used in connection with a system shown in FIG. 1 in the operating mode mentioned in the description relating to FIG. 1. Thus, the control valve unit 28 in accordance with the present invention can also be used in arbitrary other construction modifications, e.g. also when said pump 10 is speed regulated, this also having as consequence another control principle for said control valve unit 28.

What is claimed is:

1. Control valve unit (28) for an hydraulic elevator, comprising control valves (5, 15) and pilot valves ($5_v$, $15_v$) for controlling the flow of hydraulic oil from a tank (11) to a lifting cylinder (3) driving an elevator cabin (1) and/or from said lifting cylinder (3) to said tank (11), wherein for an upward movement of said elevator cabin (1) said hydraulic oil can be conveyed by means of a pump (10) driven by an electromotor (12) from said tank (11) through a control valve unit (28) to said lifting cylinder (3) and for a downward movement of said elevator cabin (1) said hydraulic oil can be conveyed through said control valve unit (28) to said tank (11), wherein for controlling said downward movement of said elevator cabin (1) one single pilotable control valve (5) is provided to act as a check valve as well as a proportional valve and for controlling said upward movement of said elevator cabin (1) one single pilotable control valve (15) is provided to act as a check valve as well as a proportional valve, characterized in that in said control valve (15) controlling the downward movement force transmission from said pilot valve (5*v*) thereof is effected by means of a piston (48) acting against a main valve regulating spring (49) via a control rod (50) to an opposed piston (38) which via a check rod (39) fixed thereto moves a flow restrictor (35), and in said control valve (15) controlling the upward movement force transmission from said pilot valve (15*v*) thereof is effected by means of a piston (68) acting against a main valve regulating spring (69) via a control rod (70) to a flow restrictor (55) and said flow restrictor (55) is solidly connected to an opposed piston (58) via a check rod (59).

2. Control valve unit (28) as defined in claim 1, characterized in that in each of said control valves (5, 15) said one single flow restrictor (35; 55) is provided for, which is shiftable with respect to a seat (36; 56).

3. Control valve unit (28) as defined in claim 2, characterized in that on said flow restrictor (35; 55) is subject to the action of a return spring (37; 57) on one hand and of said pilot valve ($5_v$; $15_v$) each of which being actuable by an electrically selectable proportional magnet ($5_M$; $5_M$).

4. Control valve unit (28) as defined in claim 2, characterized in that said flow restrictors (35; 55) are formed of a base (90) and a cylinder (91) with shell surface (92) having openings (93).

5. Control valve unit (28) as defined in claim 3, characterized in that in said control valve (15) controlling the upward movement, the return spring (57) thereof and the pilot valve ($15_v$) thereof act on the flow restrictor (55) thereof in a closing direction.

6. Control valve unit (28) as defined in claim 3, characterized in that in said control valve (5) controlling the downward movement, the return spring (37) thereof act on the flow restrictor (35) thereof in closing direction while the pilot valve ($5_v$) thereof acts in opening direction.

7. Control valve unit (28) as defined in claim 5, characterized in that said flow restrictor (35) of said control valve (5) controlling the downward movement and said flow restrictor (55) of said control valve (15) controlling said upward movement have the same shape and dimensions.

8. Control valve unit (2) as defined in claim 7, characterized in that the diameter of said opposed piston (38) being equal to the diameter of said flow restrictor (35).

9. Control valve unit (28) as defined in claim 7, characterized in that the diameter of said opposed piston (58) being equal to the diameter of said flow restrictor (55).

10. Control valve unit (28) as defined in claim 1, characterized in that said piston (48; 68) on its outer circumference comprises a groove (98) into which an elastic sealing (99) is inserted.

11. Control valve unit (28) defined in claim 1, characterized in that a surface facing said flow restrictor (35; 55), of said opposed piston (38; 58) has the shape of a truncated cone.

12. Control valve unit (28) as defined in claim 11, characterized in that a shell surface of said truncated cone (80) forms an angle $\alpha$ or about 15 to 25 degrees against a surface standing in perpendicular on the longitudinal axis.

13. Control valve unit (28) as defined in claim 12, characterized in that openings (93) at least partly are V-shaped.

14. Control valve unit (28) as defined in claim 12, characterized in that openings (93) have a bell-shaped form.

15. Control valve unit (28) as defined in claim 12, characterized in that openings (93) are stepped.

16. Control valve unit (28) as defined in claim 1, characterized in that means (95,96;97) are provided for limiting a path of said piston (48; 68).

17. Control valve unit (28) as defined in claim 16, characterized in that a retainer ring (96) is insertable into one of several annular grooves (95) grooved into the cylindrical inside wall of control chambers (47; 67) for limiting the lift.

18. Control valve unit (28) as defined in claim 16, characterized in that into a control chamber (47; 67) a cylindrical retainer ring (97) is insertable with an outer diameter slightly smaller than the diameter of said control chamber (47; 67) and having a length limitation for determining the lift.

19. Control valve unit (28) for an hydraulic elevator, comprising:

control valves (5, 15) and pilot valves ($5_v$, $15_v$) for controlling the flow of hydraulic oil from a tank (11) to a lifting cylinder (3) driving an elevator cabin (1) and/or from said lifting cylinder (3) to said tank (11), wherein for an upward movement of said elevator cabin (1) said hydraulic oil can be conveyed by means of a pump (10) driven by an electromotor (12) from said tank (11) through a control valve unit (28) to said lifting cylinder (3) and for a downward movement of said elevator cabin (1) said hydraulic oil can be conveyed through said control valve unit (28) to said tank (11), wherein each of said upward movement and said downward movement of said elevator cabin (1) is controlled by one single pilotable control valve (5, 15), respectively, provided to act as a check valve as well as a proportional valve and wherein each of said control valves (5, 15) includes one single flow restrictor (35; 55) which is shiftable with respect to a seat (36; 56) and said flow restrictor (35; 55) is subject to the action of a return spring (37; 57) on one hand and of a pilot valve ($5_v$; $15_v$) each of which being actuable by an electrically selectable proportional magnet ($5_M$; $5_M$) and in said control valve (15) controlling the upward movement, the return spring (57) thereof and the pilot valve ($15_v$) thereof act on the flow restrictor (55) thereof in a closing direction, said flow restrictor (35) of said control valve (5) controlling the downward movement and said flow restrictor (55) of said control valve (15) controlling said upward movement have the same shape and dimensions and said control valve (5) controlling the downward movement force transmission from said pilot valve ($5_v$) thereof is effected by means of a piston (48) acting against a main valve regulating spring (49) via a control rod (50) to an opposed piston (38) which via a check rod (39) fixed thereto moves said flow restrictor (35), the diameter of said opposed piston (38) being equal to the diameter of said flow restrictor (35).

20. Control valve unit (28) for an hydraulic elevator, comprising:

control valves (5, 15) and pilot valves ($5_v$, $15_v$) for controlling the flow of hydraulic oil from a tank (11) to a lifting cylinder (3) driving an elevator cabin (1) and/or from said lifting cylinder (3) to said tank (11), wherein for an upward movement of said elevator cabin (1) said hydraulic oil can be conveyed by means of a pump (10) driven by an electromotor (12) from said tank (11) through a control valve unit (28) to said lifting cylinder (3) and for a downward movement of said elevator cabin (1) said hydraulic oil can be conveyed through said control valve unit (28) to said tank (11), wherein each of said upward movement and said downward movement of said elevator cabin (1) is controlled by one single pilotable control valve (5, 15), respectively, provided to act as a check valve as well as a proportional valve and wherein each of said control valves (5, 15) includes one single flow restrictor (35; 55) which is shiftable with respect to a seat (36; 56) and said flow restrictor (35; 55) is subject to the action of a return spring (37; 57) on one hand and of a pilot valve ($5_v$; $15_v$) each of which being actuable by an electrically selectable proportional magnet ($5_M$; $5_M$) and in said control valve (15) controlling the upward movement, the return spring (57) thereof and the pilot valve ($15_v$) thereof act on the flow restrictor (55) thereof in a closing direction, said flow restrictor (35) of said control valve (5) controlling the downward movement and said flow restrictor (55) of said control valve (15) controlling said upward movement have the same shape and dimensions and said control valve (15) controlling the upward movement force transmission from said pilot valve ($15_v$) thereof is effected by means of a piston (68) acting against a main valve regulating spring (69) via a control rod (70) to said flow restrictor (55) and that said flow restrictor (55) is solidly connected to an opposed piston (58) via a check rod (59), the diameter of said opposed piston (58) being equal to the diameter of said flow restrictor (55).

* * * * *